US011238814B2

(12) United States Patent
Huang

(10) Patent No.: US 11,238,814 B2
(45) Date of Patent: Feb. 1, 2022

(54) DRIVING METHOD FOR DISPLAY APPARATUS FOR ADJUSTING GRAYSCALE VALUE OF DISPLAY IMAGE AND DISPLAY DEVICE THEREOF

(71) Applicant: HKC CORPORATION LIMITED, Shenzen (CN)

(72) Inventor: Beizhou Huang, Shenzen (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 0 days.

(21) Appl. No.: 16/759,235

(22) PCT Filed: Dec. 13, 2017

(86) PCT No.: PCT/CN2017/115784
§ 371 (c)(1),
(2) Date: Apr. 24, 2020

(87) PCT Pub. No.: WO2019/080285
PCT Pub. Date: May 2, 2019

(65) Prior Publication Data

US 2020/0380924 A1 Dec. 3, 2020

(30) Foreign Application Priority Data

Oct. 25, 2017 (CN) ..... 201711007601.5

(51) Int. Cl.
*G09G 3/34* (2006.01)
*G09G 3/36* (2006.01)

(52) U.S. Cl.
CPC ..... *G09G 3/3413* (2013.01); *G09G 3/3611* (2013.01); *G09G 2320/0626* (2013.01); *G09G 2360/16* (2013.01)

(58) Field of Classification Search
CPC ..... G09G 2320/0626; G09G 2360/16; G09G 3/3413; G09G 3/36; G09G 3/3611
See application file for complete search history.

(56) References Cited

U.S. PATENT DOCUMENTS

| | | | | |
|---|---|---|---|---|
| 8,243,010 | B2 * | 8/2012 | Lee | G09G 3/3426 345/102 |
| 2011/0115826 | A1 * | 5/2011 | Fujiwara | G09G 3/3426 345/690 |
| 2016/0148579 | A1 | 5/2016 | Kimura et al. | |

FOREIGN PATENT DOCUMENTS

| | | |
|---|---|---|
| CN | 101281732 A | 10/2008 |
| CN | 104599656 A | 5/2015 |

(Continued)

OTHER PUBLICATIONS

International Search Report issued for the corresponding international application No. PCT/CN2017/115784, dated Jul. 24, 2018, 4 pages (English Translation).

*Primary Examiner* — Kenneth Bukowski
(74) *Attorney, Agent, or Firm* — Wang Law Firm, Inc.

(57) ABSTRACT

The present disclosure illustrates a method of driving a display device, including steps of dividing an original display image into first and second display image; acquiring first, second and third mean values of the original display image; setting the mean values of the first components, the second components, and the third components of the first display image to be equal to the second mean value, and setting the mean values of the first components and the third components of the second display image to be equal to a third mean value; regulating brightness value of a backlight circuit; acquiring drive components corresponding to the pixels of the second display image; and driving the pixel units of the display device for display, according to the drive components corresponding to the pixels of the first display (Continued)

image and the drive components of the pixels of the second display image.

18 Claims, 5 Drawing Sheets

(56) References Cited

FOREIGN PATENT DOCUMENTS

| | | | |
|---|---|---|---|
| CN | 106486056 | A | 3/2017 |
| CN | 106652950 | A | 5/2017 |
| CN | 106847205 | A | 6/2017 |

* cited by examiner

DRIVING METHOD FOR DISPLAY APPARATUS FOR ADJUSTING GRAYSCALE VALUE OF DISPLAY IMAGE AND DISPLAY DEVICE THEREOF

CROSS-REFERENCE TO RELATED APPLICATION

This application is a National Stage Application of PCT International Patent Application No. PCT/CN2017/115784 filed on Dec. 13, 2017, under 35 U.S.C. § 371, which claims priority to and the benefit of Chinese Patent Application No. 201711007601.5, filed on Oct. 25, 2017, and the disclosures of which are incorporated herein in their entirety by reference.

BACKGROUND

1. Field

The present disclosure relates to a display technology field, more particularly to a display device and a method of driving the same.

2. Description of the Related Art

Most large-sized LCD devices apply vertical alignment (VA) liquid crystal technology or In-Plane Switching (IPS) technology. When being viewed under a large view angle, brightness values of the pixels of the VA type LCD device may be quickly saturated along with the drive voltage, and it causes a serious color shift phenomenon on the LCD device under the large view angle, and the display quality of the LCD device is also affected seriously.

The display panel may represent various hue combinations, and the color represented by entire display panel depends on the hue combination of the display panel. For example, when the display panel having the hue combination of red color is viewed under a front view angle, red components of the pixels of the display panel is more obvious than blue components and green components of the pixels; however, when the display panel is viewed under the large view angle (such as the view angle higher than 60 degrees), performance of the red components of the pixels of the display panel is worse than that of the blue components and the green components of the pixels of the display panel. When a ratio of the red components of the pixels among the all color components of the pixels is smaller, the color shown by the display panel is deviated from the red color more. When a difference between the color tones of the display panel under the large view angle and the front view angle is higher, the color shift problem of the display panel is more serious.

Furthermore, the ratio of the red components of the low grayscale pixels among the all color components of low grayscale pixels is lower than that of high grayscale pixels, and it means that the color shift problem of the low grayscale pixels is more serious.

SUMMARY

In order to solve above-mentioned problems, the present disclosure provides a display device and a method of driving the same to increase a ratio of grayscale value of a main color tone component among all other components, so as solve the color shift problem of the display panel under large view angle. Furthermore, the technical solution of the present disclosure can solve the problem that the difference between the ratios of grayscale values of main color tone components of the low grayscale pixels under the front view angle and the large view angle is higher than that of the high grayscale pixels.

According to an embodiment, the present disclosure provides a method of driving a display device. The method includes steps of dividing an original display image into a first display image and a second display image, and wherein each of pixels of the original display image, the first display image and the second display image comprises components corresponding a color space, and the components comprise a first component, a second component and a third component; acquiring a first mean value, a second mean value and a third mean value corresponding to the original display image, and wherein the first mean value, the second mean value and the third mean value are a mean value of the first components corresponding to the original display image, a mean value of the second components corresponding to the original display image, and a mean value of the third components corresponding to the original display image, respectively, and the first mean value is higher than the second mean value, and higher than the third mean value; setting the mean value of the first components corresponding to the first display image, the mean value of the second components corresponding to the first display image, and the mean value of the third components corresponding to the first display image to be equal to the second mean value, and setting the mean value of the first components corresponding to the second display image and the mean value of the third components corresponding to the second display image to be equal to a third mean value, and setting the mean value of the second components corresponding to the second display image to be equal to a preset mean value; regulating a brightness value of a backlight circuit according to the mean value of the first components corresponding to the original display image, the mean value of the second components corresponding to the original display image, and the mean value of the third components corresponding to the original display image, the mean value of the first components corresponding to the first display image, the mean value of the second components corresponding to the first display image, and the mean value of the third components corresponding to the first display image, and the mean value of the first components corresponding to the second display image, the mean value of the second components corresponding to the second display image, and the mean value of the third components corresponding to the second display image; acquiring a drive component corresponding to the pixel of the second display image according to the brightness value of the backlight circuit before regulation, the brightness value of the backlight circuit after regulation, the component corresponding to the pixel of the original display image, and a drive component corresponding to the pixel of the first display image, and wherein the drive component corresponding to the pixel of the first display image is equal to the second largest component corresponding to the pixel of the original display image; and driving the pixel units of the display device for display, according to the drive components corresponding to the pixels of the first display image and the drive components corresponding to the pixels of the second display image.

Preferably, the preset mean value is equal to zero.

Preferably, after the step of acquiring the drive components corresponding to the pixels of the second display image, according to the brightness value of the backlight circuit before regulation, the brightness value of the backlight circuit after regulation, the component corresponding to the pixel of the original display image, and the drive component corresponding to the pixel of the first display image, the driving method further includes a step of determining a relationship between the acquired drive component corresponding to the pixel of the second display image and zero, and a relationship between the acquired drive component and the first component corresponding to the pixel of the original display image; wherein when the acquired drive component corresponding to the pixel of the second display image is lower than zero, the drive component corresponding to the pixel of the second display image is set to be equal to zero; wherein when the acquired drive component corresponding to the pixels of the second display image are higher than a maximum component corresponding to the pixel, the drive components corresponding to the pixel of the second display image is set to be equal to the maximum component corresponding to the pixel.

Preferably, the backlight circuit comprises a first backlight circuit, a second backlight circuits and a third backlight circuit, and the step of regulating the brightness value of the backlight circuit according to the mean value of the first components corresponding to the original display image, the mean value of the second components corresponding to the original display image, and the mean value of the third components corresponding to the original display image, the mean value of the first components corresponding to the first display image, the mean value of the second components corresponding to the first display image, and the mean value of the third components corresponding to the first display image, and the mean value of the first components corresponding to the second display image, the mean value of the second components corresponding to the second display image, and the mean value of the third components corresponding to the second display image, further comprises: regulating a brightness value of the first backlight circuit according to grayscale brightness values of the mean values of the first components corresponding to the original display image, the first display image and the second display image respectively; regulating a brightness value of the second backlight circuit according to grayscale brightness values of the mean values of the second components corresponding to the original display image, the first display image and the second display image respectively; and regulating a brightness value of the third backlight circuit according to grayscale brightness values of the mean values of the third components corresponding to the original display image, the first display image and the second display image, respectively.

Preferably, the backlight circuit comprise a first backlight circuit, a second backlight circuits and a third backlight circuit, and the step of acquiring the drive component corresponding to the pixel of the second display image according to the brightness value of the backlight circuit before regulation, brightness value of the backlight circuit after regulation, the component corresponding to the pixel of the original display image, and the drive component corresponding to the pixel of the first display image, further comprise: acquiring a drive component corresponding to the first component of the pixel of the second display image, according to the brightness value of the first backlight circuit before regulation, the brightness value of the first backlight circuit after regulation, and the first component corresponding to the pixel of the original display image, and the drive component corresponding to the pixel of the first display image; acquiring a drive component corresponding to the second component of the pixel of the second display image, according to the brightness value of the second backlight circuit before regulation, the brightness value of the second backlight circuits after regulation, and the second component corresponding to the pixel of the original display image, and the drive component corresponding to the pixel of the first display image; acquiring a drive component corresponding to the third component of the pixel of the second display image according to the brightness value of the third backlight circuit before regulation, the brightness value of the third backlight circuit after regulation, and the third component corresponding to the pixel of the original display image, and the drive component corresponding to the pixel of the first display image.

Preferably, the driving method further includes steps of dividing the pixels of the original display image into a plurality of areas, wherein each of the plurality of areas comprises pixels; dividing the frame original display image in one of the plurality of areas into a first display image and a second display image; acquiring a first mean value, a second mean value and a third mean value corresponding to the original display image in the area; setting a mean value of the first components corresponding to the first display image in the area, a mean value of the second components corresponding to the first display image in the area, and a mean value of the third components corresponding to the first display image in the area to be equal to the second mean value, and setting a mean value of the first components corresponding to the second display image in the area and a mean value of the third components corresponding to the second display image in the area to be equal to the third mean value, and setting a mean value of the second components corresponding to the second display image in the area to be equal to the preset mean value; regulating the brightness value of the backlight circuit corresponding to the area, according to the mean value of the first components corresponding to the original display image in the area, the mean value of the second components corresponding to the original display image in the area, and the mean value of the third components corresponding to the original display image in the area, the mean value of the first components corresponding to the first display image in the area, the mean value of the second components corresponding to the first display image in the area, and the mean value of the third components corresponding to the first display image in the area, and the mean value of the first components corresponding to the second display image in the area, the mean value of the second components corresponding to the second display image in the area, and the mean value of the third components corresponding to the second display image in the area; acquiring the drive component corresponding to the pixel of the second display image in the area, according to the brightness value of the backlight circuit corresponding to the area before regulation, the brightness value of the backlight circuit corresponding to the area after regulation, the component corresponding to the pixel of the original display image in the area, and the drive component corresponding to the pixel of the first display image in the area; and driving the pixel units corresponding to the area of the display device for display, according to the drive components corresponding to the pixels of the first display image in the area, the drive components corresponding to the pixels of the second display image in the area.

Preferably, the preset mean value is equal to zero.

Preferably, after acquiring the drive component corresponding to the pixel of the second display image in the area according to the brightness value of the backlight circuit corresponding to the area before regulation, the brightness value of the backlight circuit corresponding to the area after regulation, the component corresponding to the pixel of the original display image in the area, and the drive component corresponding to the pixel of the first display image in the area, the method further includes steps of determining a relationship between the acquired drive component corresponding to the pixel of the second display image in the area and zero, and a relationship between the acquired drive component and the first component corresponding to the pixel of the original display image in the area; setting the drive component corresponding to the pixel of the second display image in the area to be equal to zero when the acquired drive component corresponding to the pixel of the second display image in the area is lower than zero; and setting the drive component corresponding to the pixel of the second display image in the area to be equal to the maximum component corresponding to the pixel when the acquired drive component corresponding to the pixel of the second display image in the area is higher than the maximum component corresponding to the pixel.

Preferably, the backlight circuit corresponding to the area comprises a first backlight circuit, a second backlight circuit and a third backlight circuit, and the step of regulating the brightness value of the backlight circuit corresponding to the area according to the mean value of the first components corresponding to the original display image in the area, the mean value of the second components corresponding to the original display image in the area, and the mean value of the third components corresponding to the original display image in the area, the mean value of the first components corresponding to the first display image, the mean value of the second components corresponding to the first display image, and the mean value of the third components corresponding to the first display image, and the mean value of the first components corresponding to the second display image, the mean value of the second components corresponding to the second display image, and the mean value of the third components corresponding to the second display image, further comprises: regulating a brightness value of the first backlight circuit corresponding to the area according to the grayscale brightness values of the mean values of the first components corresponding to the original display image, the first display image and the second display image in the area respectively; regulating a brightness value of the second backlight circuit corresponding to the area according to the grayscale brightness values of the mean values of the second components corresponding to the original display image, the first display image and the second display image in the area respectively; regulating a brightness value of the third backlight circuit corresponding to the area according to the grayscale brightness values of the mean values of the third components corresponding to the original display image, the first display image and the second display image in the area respectively.

Preferably, the backlight circuit corresponding to the area comprises a first backlight circuit, a second backlight circuits and a third backlight circuit, and the step of acquiring the drive component corresponding to the pixel of the second display image in the area according to the brightness value of the backlight circuit corresponding to the area before regulation, the brightness value of the backlight circuit corresponding to the area after regulation, the components corresponding to the pixels of the original display image in the area, and the drive component corresponding to the pixel of the first display image in the area, further comprises: acquiring the drive component of the first component corresponding to the pixel of the second display image in the area, according to the brightness value of the first backlight circuit corresponding to the area before regulation, the brightness value of the second backlight circuit corresponding to the area after regulation, the first component corresponding to the pixel of the original display image in the area, and the drive component corresponding to the pixel of the first display image in the area; acquiring the drive component of the second component corresponding to the pixel of the second display image in the area, according to the brightness value of the second backlight circuits corresponding to the area before regulation, the brightness value of the second backlight circuits corresponding to the area after regulation, the second component corresponding to the pixel of the original display image in the area, and the drive component corresponding to the pixel of the first display image in the area; and acquiring the drive component of the third component corresponding to the pixel of the second display image in the area, according to the brightness value of the third backlight circuit corresponding to the area before regulation, the brightness value of the third backlight circuit corresponding to the area after regulation, the third component corresponding to the pixel of the original display image in the area, and the drive component corresponding to the pixel of the first display image in the area.

According to an embodiment, the present disclosure provides a display device comprising: an image dividing circuit configured to divide an original display image into a first display image and a second display image, wherein each of pixels of the original display image, the first display image and the second display image comprises components corresponding to a color space, and the components comprise a first component, a second components and a third component; a mean value acquisition circuit electrically connected to the image dividing circuit, and configured to acquire a first mean value, a second mean value and a third mean value corresponding to the original display image, and wherein the first mean value, the second mean value and the third mean value are a mean value of the first components corresponding to the original display image, a mean value of the second components corresponding to the original display image, and a mean value of the third components corresponding to the original display image, respectively, and the first mean value is higher than the second mean values, and higher than the third mean value; a component setting circuit electrically connected to the mean value acquisition circuit, and configured to set the mean value of the first components corresponding to the first display image, the mean value of the second components corresponding to the first display image, and the mean value of the third components corresponding to the first display image to be equal to a second mean value, and set the mean value of the first components corresponding to the second display image and the mean value of the third components corresponding to the second display image to be equal to the third mean value, and set the mean value of the second components corresponding to the second display image to be equal to the preset mean value; a backlight regulation circuit electrically connected to the component setting circuit, and configured to regulate a brightness value of a backlight circuit according to the mean value of the first components corresponding to the original display image, the mean value of the second components corresponding to the original display image, and the mean value of the third components corresponding to the original display image, the mean value of the first components corresponding to the first display image, the mean value of the second components corresponding to the first display image, and the mean value of the third components corresponding to the first display image, and the mean value of the first components corresponding to the second display image, the mean value of the second components corresponding to the second display image, and the mean value of the third components corresponding to the second display image; a drive component acquisition circuit electrically connected to the backlight regulation circuit, configured to acquire a drive component corresponding to the pixel of the second display image according to the brightness value of the backlight circuit before regulation, the brightness value of the backlight circuit after regulation, the component corresponding to the pixel of the original display image, and the drive component corresponding to the pixel of the first display image, and wherein the drive components corresponding to the pixel of the first display image is equal to the second largest component corresponding to the pixel of the original display image; and a driver circuit electrically connected to the drive component acquisition circuit, and configured to according to the drive components corresponding to the pixels of the first display image, and the drive components corresponding to the pixels of the second display image, driving the pixel unit of the display device for display.

Preferably, the preset mean value is equal to zero.

Preferably, the display device further includes a relationship determination circuit electrically connected to the drive component acquisition circuit, and configured to determine a relationship between the acquired drive component corresponding to the pixel of the second display image and zero, and a relationship between the acquired drive component and the first component corresponding to the pixel of the original display image; and a drive component setting circuit electrically connected to the relationship determination circuit, and configured to set the drive component corresponding to the pixel of the second display image to be equal to zero when the acquired drive component corresponding to the pixel of the second display image is lower than zero, and set the drive component corresponding to the pixel of the second display image to be equal to the maximum component corresponding to the pixel when the acquired drive component corresponding to the pixel of the second display image is higher than the maximum component corresponding to the pixel.

Preferably, the backlight circuit comprise a first backlight circuit, a second backlight circuits and a third backlight circuit, and the backlight regulation circuit is configured to regulate a brightness value of the first backlight circuit according to grayscale brightness values of the mean values of the first components corresponding to the original display image, the first display image and the second display image respectively; regulate a brightness value of the second backlight circuit according to grayscale brightness values of the mean values of the second components corresponding to the original display image, the first display image and the second display image respectively; and regulate a brightness value of the third backlight circuit according to grayscale brightness values of the mean values of the third components corresponding to the original display image, the first display image and the second display image, respectively.

Preferably, the backlight circuit comprises a first backlight circuit, a second backlight circuits and a third backlight circuit, and the drive component acquisition circuit is configured to acquire a drive component corresponding to the first component of the pixel of the second display image according to the brightness value of the first backlight circuit before regulation, the brightness value of the first backlight circuit after regulation, and the first component corresponding to the pixel of the original display image, and the drive component corresponding to the pixel of the first display image; acquire a drive component corresponding to the second components of the pixel of the second display image according to the brightness value of the second backlight circuits before regulation, the brightness value of the second backlight circuits after regulation, and the second components corresponding to the pixel of the original display image, and the drive component corresponding to the pixel of the first display image; acquire a drive component corresponding to the third component of the pixel of the second display image according to the brightness value of the third backlight circuit before regulation, the brightness value of the third backlight circuit after regulation, and the third component corresponding to the pixel of the original display image, and the drive component corresponding to the pixel of the first display image.

Preferably, the display device further includes an area dividing circuit configured to divide the pixels of the original display image into a plurality of areas, wherein each of the plurality of area comprises pixels; an image dividing circuit electrically connected to the area dividing circuit, and configured to divide the original display image in one of the plurality of area into the first display image and the second display image; a mean value acquisition circuit configured to acquire the first mean value, the second mean value and the third mean value corresponding to the original display image in the area; a component setting circuit electrically connected to the mean value acquisition circuit, and configured to set the mean value of the first components corresponding to the first display image in the area, the mean value of the second components corresponding to the first display image in the area, and the mean value of the third components corresponding to the first display image in the area to be equal to the second mean values, and set the mean value of the first components corresponding to the second display image in the area and the mean value of the third components corresponding to the second display image in the area to be equal to the third mean value, and set the mean value of the second components corresponding to the second display image to be equal to the preset mean value; a backlight regulation circuit electrically connected to the component setting circuit, and configured to regulate the brightness value of the backlight circuit corresponding to the area, according to the mean value of the first components corresponding to the original display image in the area, the mean value of the second components corresponding to the original display image in the area, and the mean value of the third components corresponding to the original display image in the area, the mean value of the first components corresponding to the first display image in the area, the mean value of the second components corresponding to the first display image in the area, and the mean value of the third components corresponding to the first display image in the area, and the mean value of the first components corresponding to the second display image in the area, the mean value of the second components corresponding to the second display image in the area, and the mean value of the third components corresponding to the second display image in the area; a drive component acquisition circuit, electrically connected to the backlight regulation circuit, and configured to acquire the drive component corresponding to the pixel of the second display image in the area according to the brightness value of the backlight circuit corresponding to the area before regulation, the brightness value of the backlight circuit corresponding to the area after regulation, the component corresponding to the pixel of the original display image in the area, and the drive component corresponding to the pixel of the first display image in the area; a driver circuit electrically connected to the drive component acquisition circuit, and configured to drive the pixel units corresponding to the area of the display device for display, according to the drive components corresponding to the pixels of the first display image in the area, the drive components corresponding to the pixels of the second display image in the area.

Preferably, the backlight circuit corresponding to the area comprises a first backlight circuit, a second backlight circuit and a third backlight circuit, and the backlight regulation circuit configured to regulate the brightness value of the first backlight circuit corresponding to the area according to grayscale brightness values of the mean values of the first components corresponding to the original display image, the first display image and the second display image in the area respectively; regulate a brightness value of the second backlight circuit corresponding to the area according to the grayscale brightness values of the mean values of the second components corresponding to the original display image, the first display image and the second display image in the area respectively; and regulate a brightness value of the third backlight circuit corresponding to the area according to grayscale brightness values of the mean values of the third components corresponding to the original display image, the first display image and the second display image in the area respectively.

The display device according to claim 11, wherein the backlight circuit corresponding to the area comprises a first backlight circuit, a second backlight circuit and a third backlight circuit, and the drive component acquisition circuit configured to acquire drive component of the first component corresponding to the pixel of the second display image in the area according to the brightness value of the first backlight circuit corresponding to the area before regulation, the brightness value of the first backlight circuit corresponding to the area after regulation, the first component corresponding to the pixel of the original display image in the area, and the drive component corresponding to the pixel of the first display image in the area;

acquire a drive component of the second components corresponding to the pixel of the second display image in the area, according to the brightness value of the second backlight circuits corresponding to the area before regulation, the brightness value of the second backlight circuits corresponding to the area after regulation, the second components corresponding to the pixel of the original display image in the area, and the drive component corresponding to the pixel of the first display image in the area, and acquire a drive component of the third component corresponding to the pixel of the second display image in the area according to the brightness value of the third backlight circuit corresponding to the area before regulation, the brightness value of the third backlight circuit corresponding to the area after regulation, the third component corresponding to the pixel of the original display image in the area, and the drive component corresponding to the pixel of the first display image in the area.

According to an embodiment, the present disclosure provides a method of driving a display device comprising steps of dividing an original display image into a first display image and a second display image, wherein each of the pixels of the original display image, the first display image and the second display image comprises components corresponding to a color space, and the components comprise a first component, a second components and a third component; acquiring a first mean value, a second mean value and a third mean value corresponding to the original display image, wherein the first mean value, the second mean values and the third mean value are a mean value of the first components corresponding to the original display image, a mean value of the second components corresponding to the original display image, and a mean value of the third components corresponding to the original display image, respectively, wherein the first mean value is higher than the second mean value, and higher than the third mean value; setting the mean value of the first components corresponding to the first display image, the mean value of the second components corresponding to the first display image, and the mean value of the third components corresponding to the first display image to be equal to the second mean values, setting the mean value of the first components corresponding to the second display image and the mean value of the third components corresponding to the second display image to be equal to the third mean value, and setting the mean value of the second components corresponding to the second display image to be equal to the preset mean value; regulating a brightness value of the first backlight circuit according to grayscale brightness values of the mean values of the first components corresponding to the original display image, the first display image and the second display image respectively; regulating a brightness value of the second backlight circuit according to grayscale brightness values of the mean values of the second components corresponding to the original display image, the first display image and the second display image respectively; regulating a brightness value of the third backlight circuit according to grayscale brightness values of the mean values of the third components corresponding to the original display image, the first display image and the second display image, respectively;

acquiring a drive component corresponding to the first component of the pixel of the second display image according to the brightness value of the first backlight circuit before regulation, the brightness value of the first backlight circuit after regulation, and the first component corresponding to the pixel of the original display image, and the drive components corresponding to the pixels of the first display image; acquiring a drive component corresponding to the second component of the pixel of the second display image according to the brightness value of the second backlight circuits before regulation, the brightness value of the second backlight circuits after regulation, and the second component corresponding to the pixel of the original display image, and the drive components corresponding to the pixels of the first display image; acquiring a drive component corresponding to the third component of the pixel of the second display image according to the brightness value of the third backlight circuit before regulation, the brightness value of the third backlight circuit after regulation, and the third component corresponding to the pixel of the original display image, and the drive components corresponding to the pixels of the first display image; acquiring a drive component corresponding to the first component of the pixel of the second display image according to the brightness value of the first backlight circuit before regulation, the brightness value of the first backlight circuit after regulation, and the first component of a pixel of the original display image, and the drive component of the pixel of the first display image; acquiring a drive component corresponding to the second component of the pixel of the second display image according to the brightness value of the second backlight circuit before regulation, the brightness value of the second backlight circuits after regulation, and the second components of a pixel of the original display image, and the drive component of the pixel of the first display image; acquiring the drive component corresponding to the third component of the pixel of the second display image according to the brightness value of the third backlight circuit before regulation, the brightness value of the third backlight circuit after regulation, and the third component of a pixel of the original display image, and the drive component of the pixel of the first display image, wherein the first component the second component and the third component corresponding to the pixel of the first display image are equal to a second largest component corresponding to the pixel of the original display image; and driving the pixel units of the display device to display, according to the drive components of the first components, the second components and the third components of the pixels of the first display image, and the first components, the second components and the third components corresponding to the pixels of the second display image.

According to above content, the present disclosure provides a display device and a method of driving the same to increase the ratio of the grayscale value of the main color tone component of the pixel, so as to increase a ratio of grayscale value of the main color tone component among all other components, to make the color presented on the display panel closer to the main color tone, thereby solving the color shift problem of the display panel under large view angle. Furthermore, the problem that the difference between the ratios of grayscale values of main color tone components of the low grayscale pixels under the front view angle and the large view angle is higher than that of the high grayscale pixels can also be solved, and the color shift problem of the display panel under large view angle can also be solved.

BRIEF DESCRIPTION OF THE DRAWINGS

The structure, operating principle and effects of the present disclosure will be described in detail by way of various embodiments which are illustrated in the accompanying drawings.

DETAILED DESCRIPTION OF THE PREFERRED EMBODIMENTS

Figure 1:
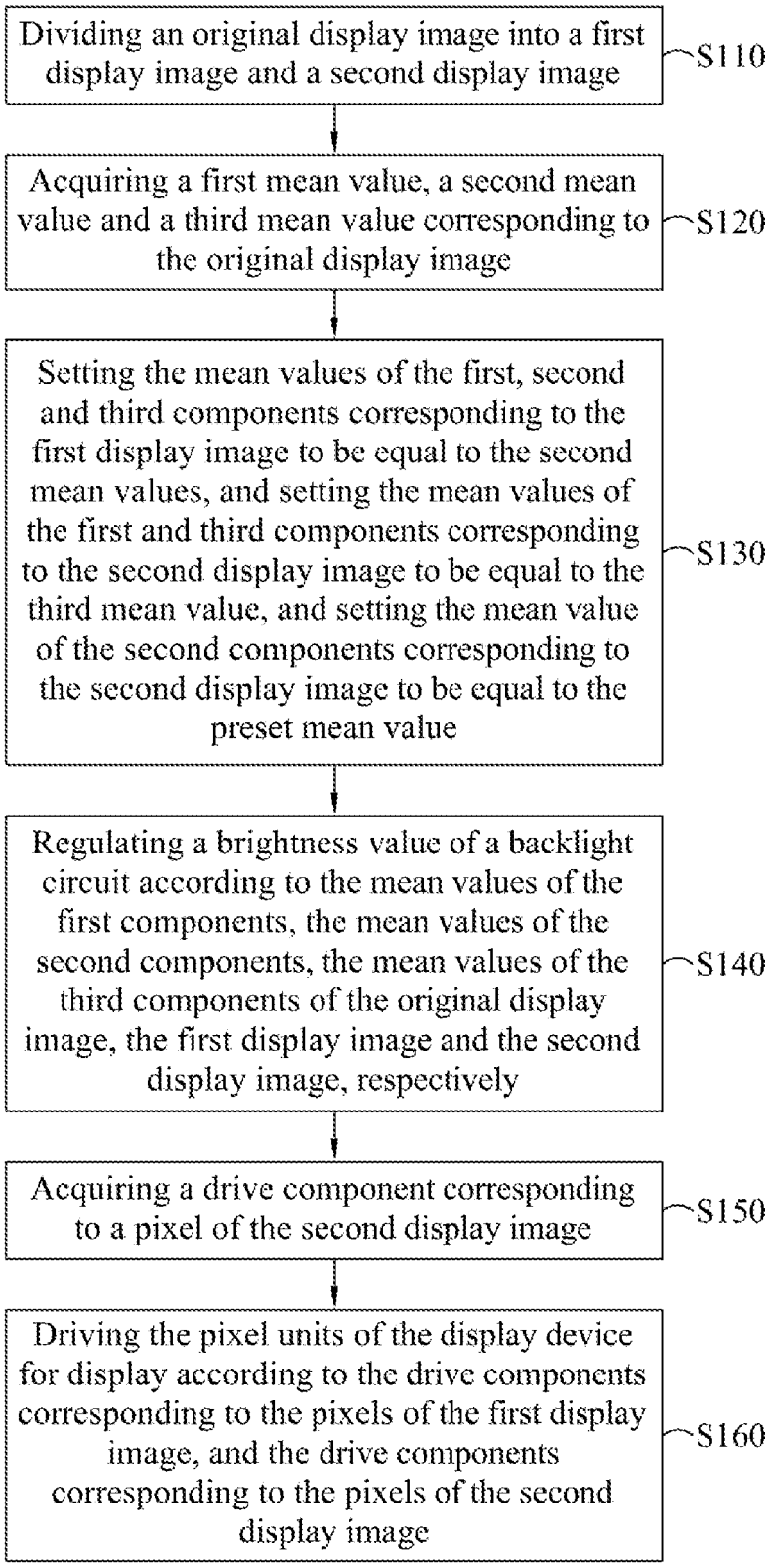
FIG. 1 is a flow chart of a method of driving a display device of an embodiment of the present disclosure.

The following embodiments of the present disclosure are herein described in detail with reference to the accompanying drawings. These drawings show specific examples of the embodiments of the present disclosure. It is to be understood that these embodiments are exemplary implementations and are not to be construed as limiting the scope of the present disclosure in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be understood that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

FIG. 1 is a flow chart of a method of driving a display device of an embodiment of the present disclosure. The driving method can be applied to drive the display device to display, and can be performed by the display device of an embodiment of the present disclosure. The method includes steps S110 through S160.

The step S110 is a step of dividing an original display image into a first display image and a second display image. Each of the pixels of the original display image, the first display image and the second display image comprises components corresponding to a color space, and the components comprise a first component, a second components and a third component. Preferably, the first component, the second component and the third component are grayscale values.

Preferably, the color space can be a RGB color space, and the first component, the second component and the third component correspond to a red component, a green component and a blue component of the RGB color space, respectively.

The step S120 is a step of acquiring a first mean value, a second mean value and a third mean value corresponding to the original display image. In an embodiment, the first mean value is a mean value of the first components of the original display image, the second mean value is a mean value of the second components of the original display image, and the third mean value is a mean value of the third components of the original display image. The first mean value is higher than the second mean values, and higher than the third mean value.

In this embodiment, each pixel of the original display image corresponds to the first component, the second component and the third component, the mean value of the first components of all pixels of the original display image can be set as the first mean value of the original display image, the mean value of the second components of all pixels of the original display image can be set as the second mean value of the original display image, and the mean value of the third components of all pixels of the original display image can be set as the third mean value of the original display image. The first mean value is higher than the second mean values, and higher than the third mean value. For example, the first component, the second component and the third component correspond to the red component, the green component and the blue component of the RGB color space, respectively. In this embodiment, the display panel is in a hue combination of red color, so entire display panel represents the red color.

The step S130 is a step of setting the mean value of the first components corresponding to the first display image, the mean value of the second components corresponding to the first display image, and the mean value of the third components corresponding to the first display image to be equal to the second mean values, and setting the mean value of the first components and the mean value of the third components corresponding to the second display image to be equal to the third mean value, and setting the mean value of the second components corresponding to the second display image to be equal to the preset mean value.

For example, the first mean value of the original display image is set to be A, the second mean value of the original display image is B, the third mean value of the original display image is C. A is higher than B, and higher than C. The mean value of the first components, the mean value of the second components, and the mean value of the third components of the first display image can be set to be B, the mean value of the first components and the mean value of the third components of the second display image can be set to be C, and the mean value of the second components of the second display image can be set to be a preset mean value.

Optionally, the mean value of the second components of the first display image is equal to the mean value of the second components of the original display image, and both mean values are equal to the second mean value. The preset mean value is set to be zero, and the mean value of the second components of the second display image is set to be zero.

The step S140 is a step of regulating a brightness value of a backlight circuit according to the mean values of the first components, the mean values of the second components, the mean values of the third components of the original display image, the first display image and the second display image, respectively.

For example, the backlight circuit can include a first backlight circuit, a second backlight circuit and a third backlight circuit, and the brightness value of the first backlight circuit can be regulated according to the grayscale values of the mean values of the first components corresponding to the original display image, the first display image and the second display image, respectively; and, the brightness value of the second backlight circuit can be regulated according to the grayscale values of the mean values of the second components corresponding to the original display image, the first display image and the second display image, respectively; and, a brightness value of the third backlight circuit can be regulated according to the grayscale values of the mean values of the third components corresponding to the original display image, the first display image and the second display image, respectively.

For example, the first component, the second components and the third component correspond to the red component, the green component and the blue component of the RGB color space, respectively. The first backlight circuit, the second backlight circuit and the third backlight circuit are a red backlight circuit, a green backlight circuit, and a blue backlight circuit, respectively. A brightness value of the red backlight circuit can be regulated according to grayscale values of the mean values of the red components of the original display image, the first display image and the second display image, respectively; and, a brightness value of the green backlight circuit can be regulated according to grayscale values of the mean values of the green components of the original display image, the first display image and the second display image, respectively; and, a brightness value of the blue backlight circuit can be regulated according to the grayscale values of the mean values of the blue components of the original display image, the first display image and the second display image, respectively.

Please refer to step S130. In this embodiment, when the display panel is viewed under the front view angle, the grayscale values of the mean value of the first components, the mean value of the second components and the mean value of the third components of the original display image are TR(A), TG(B), and TB(C), respectively. The grayscale values of the mean value of the first components, the mean value of the second components, and the mean value of the third components of the first display image are TR(B), TG(B), and TB(B), respectively. The grayscale values of the mean value of the first components, the mean value of the second components, and the mean value of the third components of the second display image are TR(C), TG(0), and TB(C), respectively. Before regulation, the brightness values of the first backlight circuit, the second backlight circuit and the third backlight circuit are AR AG and AB; and, after regulation, the brightness values of the first backlight circuit, the second backlight circuit, and the third backlight circuit are AR1, AG1 and AB1, and these three brightness values satisfy following formulas:

$$AR1 = 2 \cdot AR \cdot \frac{TR(A)}{TR(B) + TR(C)}$$

$$AG1 = 2 \cdot AG \cdot \frac{TG(B)}{TG(B) + TG(0)} = 2 \cdot AG$$

$$AB1 = 2 \cdot AB \cdot \frac{TB(C)}{TB(B) + TB(C)}$$

In this embodiment, the original display image is divided into the first display image and second display image, so a display time of each of the first and second display image becomes a half of the display time of the original display image. For this reason, in the above formula, the brightness value of the backlight circuit before regulation is multiplied by two, so that the change in display time can be compensated by the regulated brightness value of the backlight circuit.

For example, A is set to be 100, B is set to be 80, and C is set to be 40. The mean value of the first components, the mean value of the second components and the mean value of the third components of the original display image are 100, 80 and 40, respectively. The mean value of the first components, the mean value of the second components and the mean value of the third components of the first display image are set to be 80. The mean value of the first components and the mean value of the third components of the second display image are set to be 40, and the mean value of the second components of the second display image is set to be zero.

For example, according to the photoelectric characteristics of the VA type LCD panel, when a grayscale value is presented by 8 bits and in a range of 0 to 255, the grayscale brightness value and the grayscale value satisfy following formula:

$$Y = \left(\frac{X}{255}\right)^{2.2}$$

wherein X expresses the grayscale value and is above-mentioned component in this embodiment, and Y expresses the grayscale brightness value and is a normalized brightness value, and indicates the TR, TG and TB of this embodiment. X and Y match with the relationship equation with 2.2 powers. As a result, the desired grayscale brightness values can be obtained according to a lookup table or above formula, and TR(A), TG(B) and TB(C) are 13.3%, 7.4% and 1.7%, respectively; TR(B), TG(B), and TB(B) are 8.2%, 7.4% and 7.4%, respectively; and TR(C), TG(0) and TB(C) are 1.8%, 0 and 1.7%, respectively. According to aforementioned formula, AR1 is equal to 2.66 times of AR, AG1 is equal to 2 times of AG, and AB1 is equal to 0.347 times of AB.

For example, according to the photoelectric characteristics of the VA type LCD panel, when the display panel is viewed under the front view angle, the grayscale value and the grayscale brightness value match the relationship equation with 2.2 powers; and under side view angle, the grayscale values and the grayscale brightness values correspond to each other one by one, and are associated with the pixel design of the VA type LCD panel. For example, the display panel under the side view angle satisfies following condition: when the mean value of the first components, the mean value of the second components and the mean value of the third components of the original display image are 100, 80 and 40, respectively, the mean value of the first components, the mean value of the second components and the mean value of the third components of the first display image are 80, and the mean value of the first components, the mean value of the third components of the second display image are 40, and the mean value of the second components of the second display image is 0, and the grayscale brightness value TR1(A), TG1(B) and TB1 (C) of aforementioned components are 39%, 34.7% and 23.1%, respectively; TR1(B), TG1(B) and TB1(B) are 32.6%, 34.7% and 42.1%, respectively; TR1(C), TG1(0) and TB1 (C) are 17.6%, 0 and 23.1%, respectively. For the first display image and the second display image, the ratios D1, D2 and D3 of the grayscale brightness values of the first components satisfy the following formulas:

$$D1=2.66\cdot[TR1(B)+TR1(C)]$$

$$D2=2\cdot[TG1(B)+TG1(0)]$$

$$D3=0.374\cdot[TB1(B)+TB1(C)]$$

According to aforementioned parameters and formula, D1, D2 and D3 are calculated to be 133.5%, 69.4% and 24.4%, respectively. Under the side view angle, compared with the TR1(A), TG1(B) and TB1(C) being 39%, 34.7% and 23.1%, respectively, the ratio of the red component to green component is increased from 1.124 (39%/34.7%) to 1.924 (133.5%/69.4%), and the ratio of the red component to the blue component is increased from 1.688 (39%/23.1%) to 5.471 (133.5%/24.4%), so that the ratio of the grayscale brightness value of the main color tone component (such as, the red component) is increased effectively, so as to increase the ratio of the main color tone component to other component under the side view angle (that is, the large view angle), and make the color shown on the display panel closer to the main color tone, thereby solving the color shift problem of the display panel under large view angle, and solving the problem that the difference of the ratios of the main color tone component to other component of the low grayscale pixel under the front view angle and large view angle is higher than that of the high grayscale pixel, and solving the color shift problem of the display panel under large view angle. The large view angle can be an included angle from the normal line of the display panel and higher than a preset angle such as 60 degrees or 80 degrees. The low grayscale can be the grayscale value lower than a first threshold, and the high grayscale can be the grayscale value higher than a second thresholds. The first threshold can be equal to or non-equal to the second threshold. A grayscale value is presented by 8 bits and in a range of 0 to 255, for example, the grayscale in a range of 0 to 127 is the low grayscale, the grayscale in a range of 128 to 255 is the high grayscale.

The step S150 is a step of acquiring a drive component corresponding to a pixel of the second display image, according to the brightness values of the backlight circuit before regulation and after the regulation, and the component of the pixel of the original display image, and the drive components corresponding to the pixel of the first display image. The drive components corresponding to the pixel of the first display image corresponding to the second display image is equal to the second largest component corresponding to the pixel of the original display image.

For example, the backlight circuit includes the first backlight circuit, the second backlight circuits and the third backlight circuit, and the drive component corresponding to the first component of the pixel of the second display image can be acquired according to the brightness values of the first backlight circuit before regulation and after the regulation, and the first component of the pixel of the original display image, and the drive components corresponding to the pixel of the first display image; and, the drive component corresponding to the second components of the pixel of the second display image can be acquired according to the brightness values of the second backlight circuits before regulation and after the regulation, and the second components of the pixel of the original display image, and the drive components corresponding to the pixel of the first display image; and, the drive component corresponding to the third component of the pixel of the second display image can be acquired, according to the brightness values of the third backlight circuit before regulation and after the regulation, and the third component of the pixel of the original display image, and the drive components corresponding to the pixel of the first display image.

For example, the first component, the second components and the third component correspond to the red component, the green component and the blue component of the RGB color space, respectively; and, the first backlight circuit, the second backlight circuits and the third backlight circuit are the red backlight circuit, the green backlight circuit, and the blue backlight circuit, respectively. According to the brightness values of the red backlight circuit before regulation and after the regulation, and the red component of the pixel of the original display image, and the drive components corresponding to the pixel of the first display image, the drive component of the red component of the pixel of the second display image can be acquired; and, according to the brightness values of the green backlight circuit before regulation and after the regulation, and the green component of the pixel of the original display image, and the drive components corresponding to the pixel of the first display image, the drive component corresponding to the green component of the pixel of the second display image can be acquired; and, according to the brightness values of the blue backlight circuit before regulation and after the regulation, and the blue component of the pixel of the original display image, and the drive components corresponding to the pixel of the first display image, the drive component corresponding to the blue component of the pixel of the second display image can be acquired.

Please refer to steps S130 and S140. In this embodiment, in a first condition, a magnitude relationship of the first component of the pixel of the original display image is equal to a magnitude relationship of the mean value of the first components of the original display image; and, a magnitude relationship of the second component of the pixel of the original display image is equal to of the mean value of the second components of the original display image; and, a magnitude relationship of the third component of the pixel of the original display image is equal to of the mean value of the third components of the original display image. In other words, the mean value of the first components of the original display image is higher than the mean value of the second components of the original display image, and also higher than the mean value of the third components of the original display image, and the first component of the pixel of the original display image is higher than the second component of the pixel, and higher than the third component of the pixel.

For example, the first component, the second component and the third component of the pixel of the original display image are A1, B1 and C1, respectively, and A1 is higher than B1 and higher than C1; the grayscale brightness values of 1, B1 and C1 are TR(A1), TG(B1) and TB(C1). The drive component corresponding to the first component, the drive component corresponding to the second component, and the drive component of corresponding to the third component of the pixel of the first display image are set to be B1; that is, the drive components of the pixel of the first display image are set to be the second largest component of the pixel of the original display image, and the grayscale brightness values of the three drive components are TR(B1), TG(B1) and TB(B1), respectively. According to the calculation formula of the brightness values AR1, AG1 and AB1 of the backlight circuit after regulation, the drive component TR1 corresponding the first component, the drive component TG1 corresponding to the second component and the drive component TB1 corresponding to the third component of the pixel of the second display image satisfy the following formulas:

$$TR1 = \frac{2 \cdot AR \cdot TR(A1)}{AR1} - TR(B1) = \frac{TR(A1) \cdot [TR(B) + TR(C)]}{TR(A)} - TR(B1)$$

$$TG1 = \frac{2 \cdot AG \cdot TG(B1)}{AG1} - TG(B1) = \frac{TG(B1) \cdot [TG(B) + TG(0)]}{TG(B)} - TG(B1) = 0$$

$$TB1 = \frac{2 \cdot AB \cdot TB(C1)}{AB1} - TB(B1) = \frac{TB(C1) \cdot [TB(B) + TB(C)]}{TB(C)} - TB(B1)$$

In a second condition, the magnitude relationship between the first component, the second component and the third component corresponding to the pixel of the original display image is different from the magnitude relationship between the mean value of the first components, mean value of the second components and the mean value of the third components of the original display image, for example, the mean value of the first components of the original display image is higher than the mean value of the second components of the original display image, and also higher than the mean value of the third components; and, the second components of the pixel of the original display image is higher than the third component of the pixel, and also higher than the first component of the pixel.

For example, the first component, the second component and the third component corresponding to the pixel of the original display image are A2, B2 and C2, respectively, and B2 is higher than C2 and higher than A2. The grayscale brightness values corresponding to the three components are TR(A2), TG(B2) and TB(C2), respectively. The drive component corresponding to the first component, the drive component corresponding to the second component and the drive component corresponding to the third component are set to be C2, C2 and C2, respectively, that is, the drive components corresponding to the pixel of the first display image are equal to the second largest component corresponding to the pixel of the original display image, and grayscale brightness values are TR(C2), TG(C2) and TB(C2), respectively. According to the calculation formula of the brightness values AR1, AG1 and AB1 of the backlight circuit after regulation, the drive component TR1 corresponding the first component, the drive component TG1 corresponding to the second component and the drive component TB1 corresponding to the third component of the pixel of the second display image satisfy the following formulas:

$$TR2 = \frac{2 \cdot AR \cdot TR(A2)}{AR1} - TR(C2) = \frac{TR(A2) \cdot [TR(B) + TR(C)]}{TR(A)} - TR(C2)$$

$$TG2 = \frac{2 \cdot AG \cdot TG(B2)}{AG1} - TG(C2) = \frac{TG(B2) \cdot [TG(B) + TG(0)]}{TG(B)} - TG(C2) = TG(B2) - TG(C2)$$

$$TB2 = \frac{2 \cdot AB \cdot TB(C2)}{AB1} - TB(C2) = \frac{TB(C2) \cdot [TB(B) + TB(C)]}{TB(C)} - TB(BC2)$$

Optionally, after the drive components corresponding to each pixel of the second display image is acquired, a relationship between the acquired drive components corresponding to the pixel of the second display image and zero must be determined, and a relationship between the acquired drive components and the first component corresponding to the pixel of the original display image. When the acquired drive component corresponding to the pixel of the second display image is lower than zero, the drive component corresponding to the pixel of the second display image is set to be zero; when the acquired drive component corresponding to the pixel of the second display image is higher than the maximum component corresponding to the pixel, that is full grayscale, so he drive component corresponding to the pixel of the second display image is set to be the maximum component corresponding to the pixel.

In this embodiment, for the second condition, the magnitude relationship between the first component, the second component and the third component of the pixel of the original display image is different from the magnitude relationship between the mean value of the first components, the mean value of the second components, and the mean value of the third components of the original display image, so TR2, TG2 and TB2 calculated according to the above formula may be lower than zero or higher than the maximum component of the pixel of the original display image; for example, for the grayscale value with 8 bits, the maximum component can be a 255 of grayscale. Before determination of the second component, the relationships between the drive components of the pixel of the second display image and the zero must be determined, and the relationships between the drive components of the pixel of the second display image and the maximum component (for example, for the grayscale value with 8 bits, the maximum component can be a 255 of grayscale) of the pixel must be determined. When the acquire drive component of the pixel of the second display image is lower than 0, the drive component corresponding to the pixel of the second display image is set to be zero; when the acquired drive component of the pixel of the second display image is higher than the maximum component (for example, for the grayscale value with 8 bits, the maximum component can be a 255 of grayscale) of the pixel, the drive component corresponding to the pixel of the second display image is set to be the maximum component corresponding to the pixel, for example, the maximum component can be a 255 of grayscale, so as to ensure the pixel unit of the display panel to display normally.

The step S160 is a step of driving the pixel units of the display device for display according to the drive components corresponding to the pixels of the first display image, and the drive components corresponding to the pixels of the second display image.

In this embodiment, the component is the grayscale value, and each grayscale value corresponds to a drive voltage of a pixel unit. When the magnitude relationship between the first component, the second component and the third component of the pixel of the original display image is equal to the magnitude relationship between the mean value of the first components, the mean value of the second components, and the mean value of the third components of the original display image, the drive components (for example, the grayscale values corresponding to TR1, TG1 and TB1) of the pixel of the second display image and the drive components (that is, B1) corresponding to the pixel of the first display image calculated according to above formula can be used to drive the red pixel units, the green pixel units and the blue pixel units of the display device.

When the magnitude relationship between the first component, the second component and the third component of the pixel of the original display image is different from the magnitude relationship between the mean value of the first components, the mean value of the second components, and the mean value of the third components of the original display image, the drive components (such as the grayscale values corresponding to TR2, TG2 and TB2) of the pixel of the second display image, and the drive components (such as C2) corresponding to the pixel of the first display image calculated according to above formula, can be used to drive the red the pixel units, the green the pixel units and the blue the pixel units of the display device to display.

Figure 2:
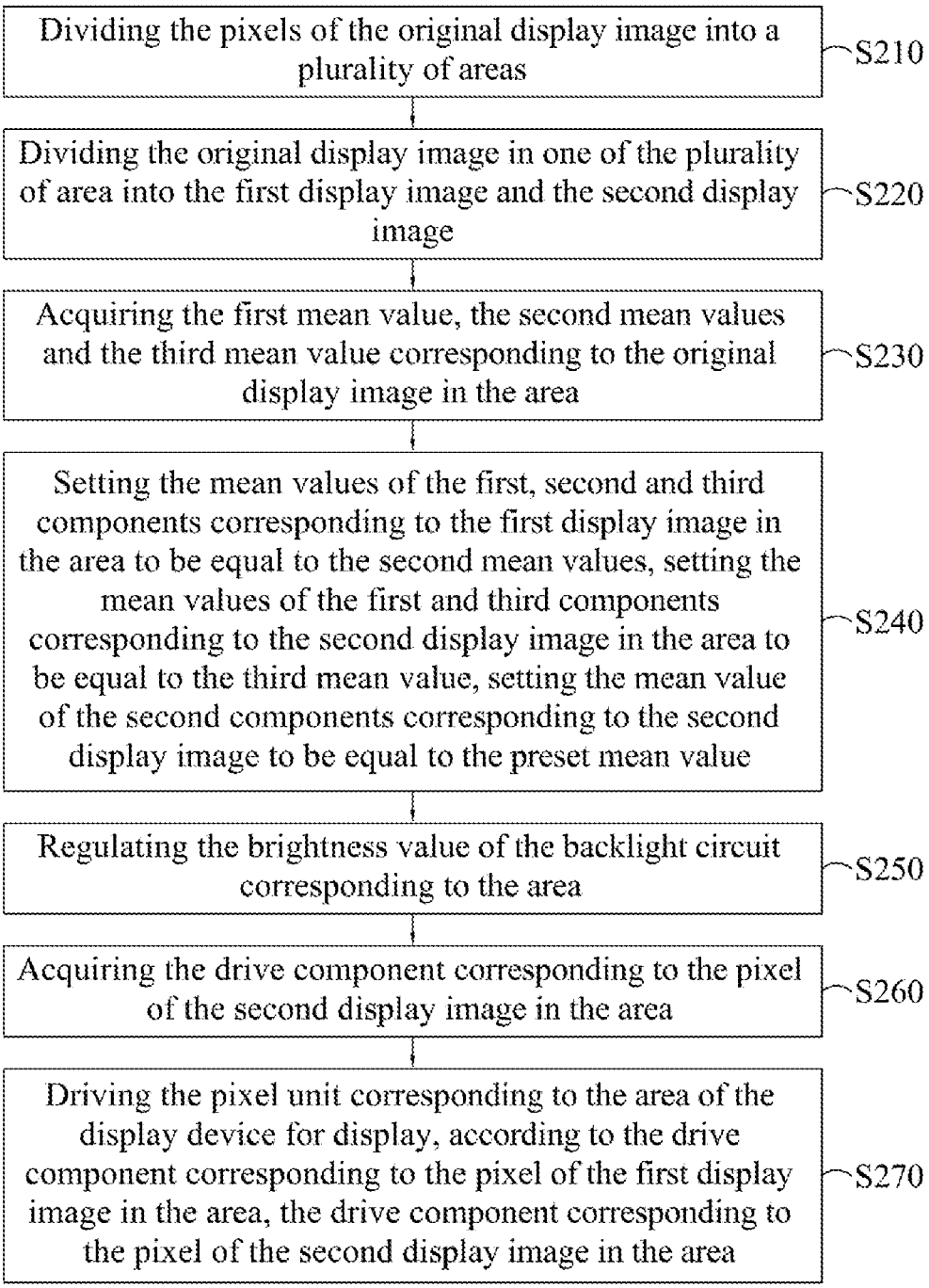
FIG. 2 is a flow chart of a method of driving a display device of other embodiment of the present disclosure.

FIG. 2 is a flow chart of a method of driving a display device of an embodiment of the present disclosure. The driving method can be applied to the display device for display, and can be performed by the display device of this embodiment. The method includes steps S210 through S270.

The step S210 is a step of dividing the pixels of the original display image into a plurality of areas. Each of the plurality of areas includes pixels.

In this embodiment, the original display image includes a plurality of pixels arranged in a matrix, the pixels of the original display image can be divided into a plurality of areas, and each area includes pixels arranged in multiple rows and multiple columns.

The step S220 is a step of dividing the original display image in one of the plurality of area into the first display image and the second display image.

For example, the original display image corresponding to a divided area or multiple divided areas can be divided into a first display image and a second display image. Each pixel of the original display image, the first display image and the second display image in the area includes the first component, the second component and the third component all corresponding to the color space.

The step S230 is a step of acquiring the first mean value, the second mean values and the third mean value corresponding to the original display image in the area.

In this embodiment, the mean value of the first components, the mean value of the second components and the mean value of the third components of all pixels of the original display image in the area are set to be the first mean value, the second mean value and the third mean value corresponding to the original display image, respectively. The first mean value is higher than the second mean values, and higher than the third mean value.

The step S240 is a step of setting the mean value of the first components, the mean value of the second components, and the mean value of the third components corresponding to the first display image in the area to be equal to the second mean values, and setting the mean value of the first components and the mean value of the third components corresponding to the second display image in the area to be equal to the third mean value, and setting the mean value of the second components corresponding to the second display image to be equal to the preset mean value.

For example, the first mean value corresponding to the original display image in the area is set to be A, the second mean values is set to be B, the third mean value is set to be C, and A is higher than B, and higher than C. The mean value of the first components, the mean value of the second components and the mean value of the third components of the first display image in the area are set to be B, the mean value of the first components and the mean value of the third components of the second display image in the area are set to be C, and the mean value of the second components of the second display image is set to be the preset mean value, for example, the preset mean value is set to be zero.

The step S250 is a step of regulating the brightness value of the backlight circuit corresponding to the area, according to the mean values of the first components, the mean values of the second components, the mean values of the third components of the original display image, the first display image and the second display image in the area.

For example, the backlight circuit may include the first backlight circuit, the second backlight circuits and the third backlight circuit. According to the grayscale values of the mean values of the first components corresponding to the original display image, the first display image and the second display image in the area respectively, the brightness value of the first backlight circuit corresponding to the area can be regulated; according to the grayscale values of the mean values of the second components corresponding to the original display image, the first display image and the second display image in the area respectively, the brightness value of the first backlight circuit corresponding to the area can be regulated; and, according to the grayscale values of the mean values of the first components corresponding to the original display image, the first display image and the second display image in the area respectively, the brightness value of the third backlight circuit corresponding to the area can be regulated. The formula of calculating the backlight brightness value of this embodiment is similar to the formula of calculating AR1, AG1 and AB1 in the step S140, so detailed description is not repeated.

Figure 3:
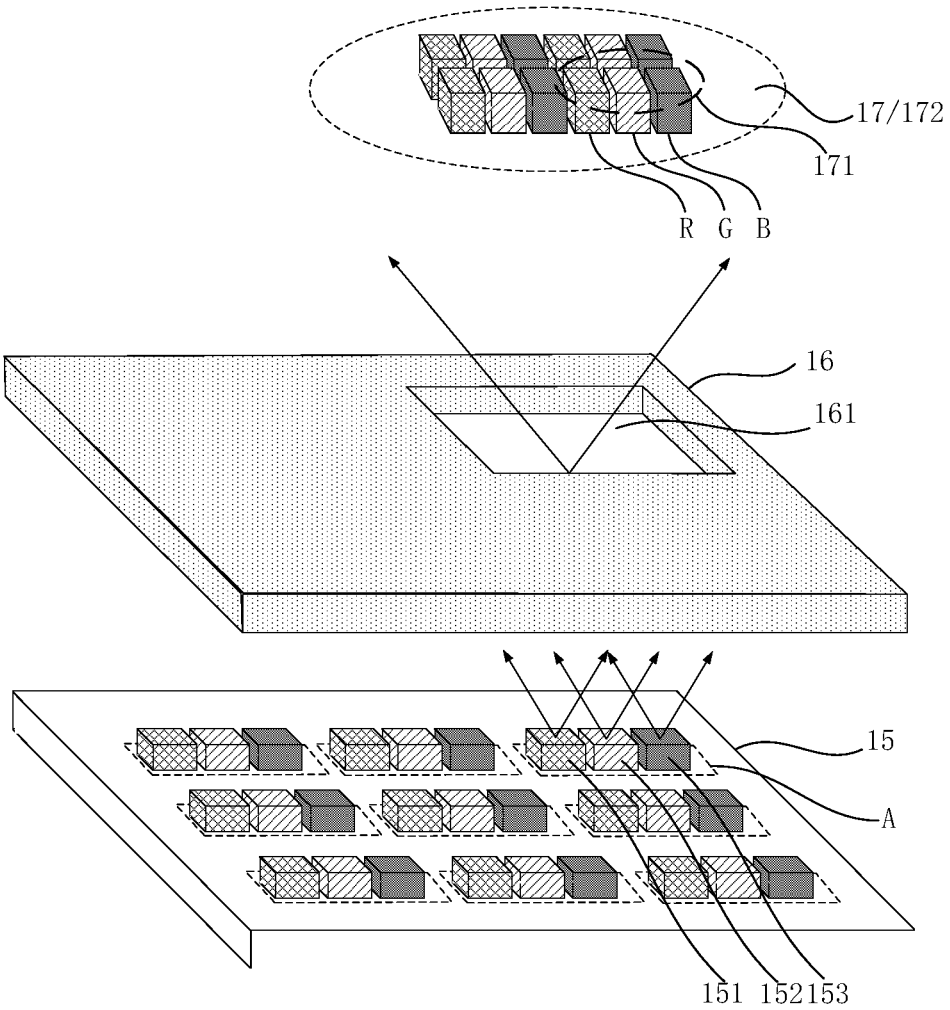
FIG. 3 is a schematic structural view of a display device of an embodiment of the present disclosure.

FIG. 3 is a schematic structural view of a display device of an embodiment of the present disclosure. In this embodiment, the display device can be a liquid crystal display device, as shown in FIG. 3, the display device includes a display panel and a backlight circuit 15 disposed under the display panel, and the backlight circuit 15 provides light to the display panel for display. The display panel includes an array substrate 16 adjacent to the backlight circuit, and a color film substrate 17 is disposed at a side of the array substrate 16 away from the backlight circuit 15, and FIG. 3 shows a part of the color film substrate 17. The backlight circuit 15 includes a plurality of red backlight circuits 151, a plurality of green backlight circuits 152 and a plurality of blue backlight circuits 153. The color film substrate 17 includes a plurality of pixel unit 171 corresponding to the red backlight circuits 151, the green backlight circuits 152 and the blue backlight circuits 153, and FIG. 3 shows four pixel units 171. Each pixel unit 171 includes a red pixel unit R, a green pixel unit G and a blue pixel unit B. The light emitted from the backlight circuit 15 is passed through opening areas 161 on the array substrate 16 to radiate on the liquid crystal layer (not shown in FIG. 3) between the array substrate 16 and the color film substrate 17, so as to enable the LCD panel to display normally.

For example, as shown in FIG. 3, the divided area for the pixels of the original display image corresponds to the area 172 formed by the pixel unit of FIG. 3, and the area 172 includes a backlight circuit area A including a group of red backlight circuits 151, green backlight circuits 152 and blue backlight circuits 153. According to the mean values of the first components, the mean values of the second components and the mean values of the third components of the original display image, the first display image and the second display image in the area 172 formed by the pixel unit, the brightness value of the backlight circuit corresponding to the area, the brightness values of the red backlight circuit 151, the green backlight circuit 152 and the blue backlight circuit 153 in the backlight circuit area A can be regulated.

The step S260 is a step of acquiring the drive component corresponding to the pixel of the second display image in the area, according to the brightness values of the backlight circuit in the area before regulation and after regulation, the component of the pixel of the original display image in the area, and the drive component corresponding to the pixel of the first display image in the area.

For example, the drive component of the first component corresponding to the pixel of the second display image in the area can be acquired according to the brightness values of the first backlight circuit in the area before regulation and after regulation, the first component of the pixel of the original display image in the area and the drive component corresponding to the pixel of the first display image in the area; and, the drive component of the second components corresponding to the pixel of the second display image in the area can be acquired according to the brightness values of the second backlight circuits in the area before regulation and after regulation, the second components of the pixel of the original display image in the area and the drive component corresponding to the pixel of the first display image in the area; and, the drive component of the third component corresponding to the pixel of the second display image in the area can be acquired according to the brightness values of the third backlight circuit in the area before regulation and after regulation, the third component of the pixel of the original display image in the area and the drive component corresponding to the pixel of the first display image in the area. The formula of calculating the drive components of the first component, the second component and the third component of the pixel of the second display image in the particular area in this embodiment is similar to the formula of calculating TR1, TG1 and TB1, and TR2, TG2 and TB2 in the step S150, so detailed description is not repeated.

The step S270 is a step of driving the pixel unit corresponding to the area of the display device for display, according to the drive component corresponding to the pixel of the first display image in the area, the drive component corresponding to the pixel of the second display image in the area.

In this embodiment, the pixel unit corresponding to the area of the display device can be driven to display, according to the drive component corresponding to the pixel of the second display image in the area and the drive component corresponding to the pixel of the first display image in the area, and the drive components are acquired in the step S260. By dividing the pixels of the original display image into the plurality of areas, the brightness value of the backlight circuit of the display device can be more precisely regulated, so as to more precisely control the drive components corresponding to the pixels of the first display image and the pixels of the second display image.

It is to be noted that the figure of this embodiment shows the sizes of the components exemplarily, and the sizes shown in figure does not represent the actual sizes of the components of the display panel.

Figure 4:
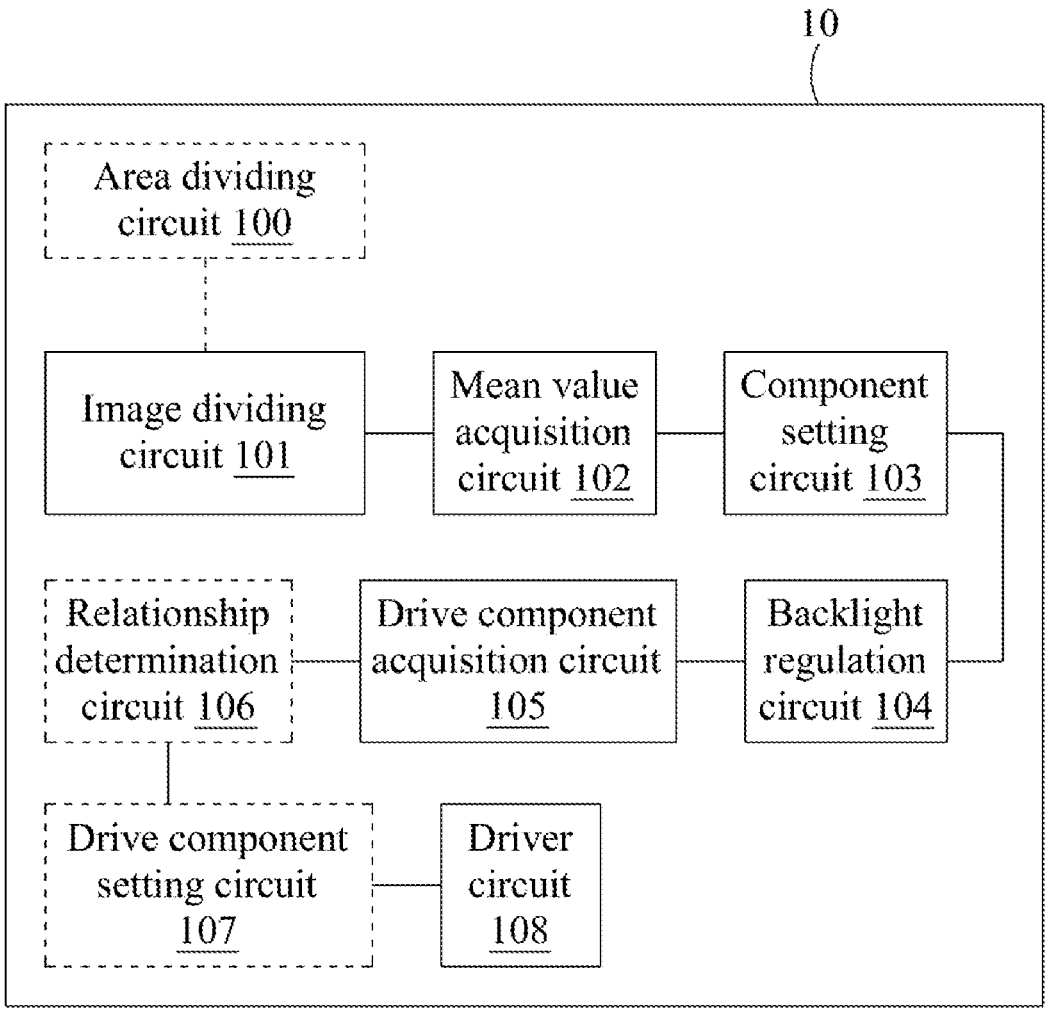
FIG. 4 is a schematic structural view of a display device of other embodiment of the present disclosure.

FIG. 4 is a schematic structural view of a display device of other embodiment of the present disclosure. As shown in FIG. 4, the display device 10 includes an image dividing circuit 101, a mean value acquisition circuit 102, a component setting circuit 103, a backlight regulation circuit 104, a drive component acquisition circuit 105 and a driver circuit 106. The mean value acquisition circuit 102 is electrically connected to the image dividing circuit 101 and the component setting circuit 103, the backlight regulation circuit 104 is electrically connected to the component setting circuit 103 and the drive component acquisition circuit 105, and the driver circuit 106 is electrically connected to the drive component acquisition circuit 105.

The image dividing circuit 101 is configured to divide the original display image into the first display image and the second display image. Each of the pixels of the original display image, the first display image and the second display image comprises the components corresponding to the color space, and the components comprise the first component, the second components and the third component. The mean value acquisition circuit 102 is configured to acquire the first mean value, the second mean value and the third mean value corresponding to the original display image. The first mean value, the second mean value and the third mean value are the mean value of the first component corresponding to the original display image, the mean value of the second components corresponding to the original display image, and the mean value of the third components corresponding to the original display image, respectively. Preferably, the first mean value is higher than the second mean values, and higher than the third mean value. The component setting circuit 103 is configured to set the mean value of the first components, the mean value of the second components, and the mean value of the third components of the first display image to be the second mean value, set the mean value of the first components and the mean value of the third components corresponding to the second display image to be the third mean value, and set the mean value of the second components corresponding to the second display image to be the preset mean value. The backlight regulation circuit 104 is configured to regulate the brightness value of the backlight circuit according to the mean values of the first components, the mean values of the second components and the mean values of the third components of the original display image, the first display image and the second display image, respectively. The drive component acquisition circuit 105 is configured to acquire the drive component corresponding to the pixel of the second display image, according to the brightness values of the backlight circuit before regulation and after regulation, the component of the pixel of the original display image, and the drive components corresponding to the pixel of the first display image. The drive components corresponding to the pixel of the first display image corresponding to the second display image is equal to the second largest component corresponding to the pixel of the original display image. The driver circuit 106 is configured to drive the pixel unit of the display device for display, according to the drive component corresponding to the pixel of the first display image, and the drive component corresponding to the pixel of the second display image.

Optionally, the display device may include a relationship determination circuit 106, a drive component setting circuit 107. The relationship determination circuit 106 is electrically connected to the drive component acquisition circuit 105, and configured to determine the relationships between the acquired drive components corresponding to the pixel of the second display image and zero, and the relationships between the acquired drive components and the first component corresponding to the pixel of the original display image.

The drive component setting circuit 107 is electrically connected to the relationship determination circuit 106, and configured to set the drive component corresponding to the pixel of the second display image to be zero when the acquired drive component corresponding to the pixel of the second display image is lower than zero, and set the drive component corresponding to the pixel of the second display image to be the maximum component corresponding to the pixel when the acquired drive component corresponding to the pixel of the second display image is higher than the maximum component corresponding to the pixel.

Optionally, the display device may include an area dividing circuit 100 configured to divide the pixels of the original display image into a plurality of areas, and each of the plurality of area comprises the pixels.

The image dividing circuit 101 is electrically connected to the area dividing circuit 100, and can divide the original display image in one of the plurality of areas into the first display image and the second display image.

The mean value acquisition circuit 102 can acquire the first mean value, the second mean values and the third mean value corresponding to the original display image in the area.

The component setting circuit 103 can be electrically connected to the mean value acquisition circuit 102, and can set the mean value of the first components corresponding to the first display image in the area, the mean value of the second components corresponding to the first display image in the area, and the mean value of the third components corresponding to the first display image in the area to be the second mean values, and set the mean value of the first components corresponding to the second display image in the area and the mean value of the third components corresponding to the second display image in the area to be the third mean value, and set the mean value of the second components corresponding to the second display image to be the preset mean value.

The backlight regulation circuit 104 can be electrically connected to the component setting circuit 103, and can regulate the brightness value of the backlight circuit corresponding to the area, according to the mean value of the first components corresponding to the original display image in the area, the mean value of the second components corresponding to the original display image in the area, and the mean value of the third components corresponding to the original display image in the area, the mean value of the first components corresponding to the first display image, the mean value of the second components corresponding to the first display image, and the mean value of the third components corresponding to the first display image, and the mean value of the first components corresponding to the second display image, the mean value of the second components corresponding to the second display image, and the mean value of the third components corresponding to the second display image.

The drive component acquisition circuit 105 can be electrically connected to the backlight regulation circuit 104, and can acquire the drive component corresponding to the pixel of the second display image in the area according to the brightness value of the backlight circuit corresponding to the area before regulation, the brightness value of the backlight circuit corresponding to the area after regulation, the component corresponding to the pixel of the original display image in the area, and the drive component corresponding to the pixel of the first display image in the area.

The driver circuit 108 can be electrically connected to the drive component acquisition circuit 105, and configured to drive the pixel unit corresponding to the area of the display device for display, according to the drive components corresponding to the pixels of the first display image in the area, and the drive components corresponding to the pixels of the second display image in the area.

Figure 5:
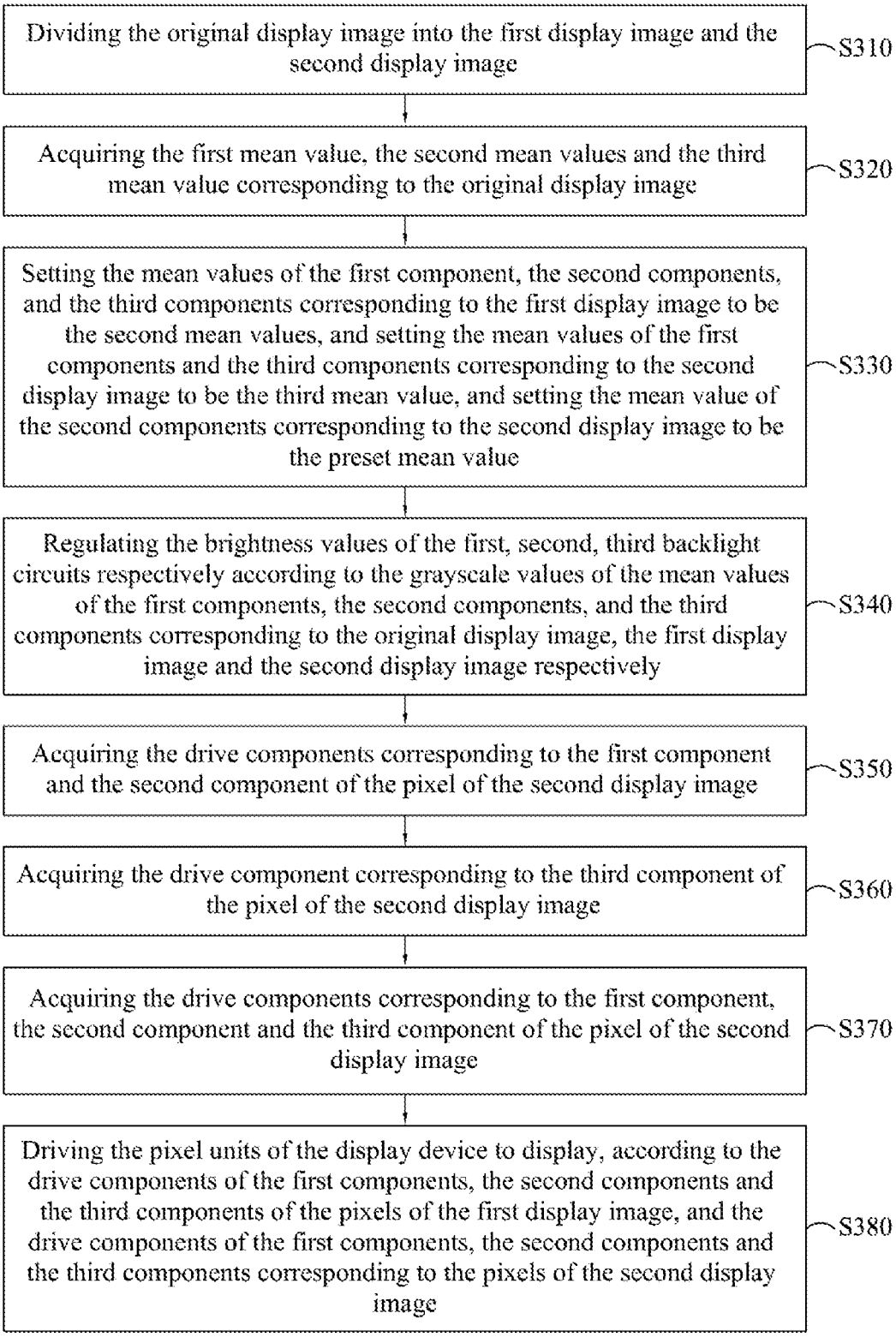
FIG. 5 is a flow chart of a method of driving display device of another embodiment of the present disclosure.

FIG. 5 is a flow chart of a method of driving display device of other embodiment of the present disclosure. The driving method can be applied to the display device for display, and can be performed by the display device of this embodiment. The method includes steps S310 through S380.

The step S310 is a step of dividing the original display image into the first display image and the second display image. Each of the pixels of the original display image, the first display image and the second display image comprises the components corresponding to the color space, and the components comprise the first component, the second components and the third component.

The step S320 is a step of acquiring the first mean value, the second mean values and the third mean value corresponding to the original display image. The first mean value, the second mean values and the third mean value are the mean value of the first component corresponding to the original display image, the mean value of the second components corresponding to the original display image, and the mean value of the third components corresponding to the original display image, respectively. The first mean value is higher than the second mean values, and higher than the third mean value.

The step S330 is a step of setting the mean values of the first component, the second components, and the third components corresponding to the first display image to be the second mean values, and setting the mean values of the first components and the third components corresponding to the second display image to be the third mean value, and setting the mean value of the second components corresponding to the second display image to be the preset mean value.

The step S340 is a step of regulating the brightness value of the first backlight circuit according to the grayscale values of the mean values of the first components corresponding to the original display image, the first display image and the second display image respectively. In this embodiment, the brightness value of the first backlight circuit can be regulated according to the grayscale values of the mean values of the first components corresponding to the original display image, the first display image and the second display image respectively; the brightness value of the second backlight circuit can be regulated according to the grayscale values of the mean values of the second components corresponding to the original display image, the first display image and the second display image, respectively; and, the brightness value of the third backlight circuit can be regulated according to the grayscale values of the mean values of the third components corresponding to the original display image, the first display image and the second display image, respectively.

The step S350 is a step of acquiring the drive component corresponding to the first component of the pixel of the second display image, according to the brightness values of the first backlight circuit before regulation and after the regulation, and the first component of the pixel of the original display image, and the drive component corresponding to the pixel of the first display image; and acquiring the drive component corresponding to the second components of the pixel of the second display image, according to the brightness values of the second backlight circuit before regulation and after the regulation, and the second components of the pixel of the original display image, and the drive component corresponding to the pixel of the first display image.

The step S360 is a step of acquiring the drive component corresponding to the third component of the pixel of the second display image, according to the brightness values of the third backlight circuit before regulation and after the regulation, and the third component of the pixel of the original display image, and the drive component corresponding to the pixel of the first display image.

The step S370 is a step of acquiring the drive component corresponding to the first component of the pixel of the second display image, according to the brightness values of the first backlight circuit before regulation and after regulation, the first component of the pixel of the original display image, and the drive component of the pixel of the first display image; acquiring the drive component corresponding to the second component of the pixel of the second display image, according to the brightness values of the second backlight circuits before regulation and after regulation, the second components of the pixel of the original display image, and the drive component of the pixel of the first display image; acquiring the drive component corresponding to the third component of the pixel of the second display image, according to the brightness values of the third backlight circuit before regulation and after regulation, the third component of the pixel of the original display image, and the drive component of the pixel of the first display image. The drive components of the first component, the second component and the third component corresponding to the pixel of the first display image are equal to the second largest component corresponding to the pixel of the original display image.

The step S380 is a step of driving the pixel units of the display device to display, according to the drive components of the first components, the second components and the third components of the pixels of the first display image, and the drive components of the first components, the second components and the third components corresponding to the pixels of the second display image.

In this embodiment, the original display image is divided into the first display image and the second display image, the first component of the original display image having the maximum grayscale value is divided into a component of the first display image having smaller grayscale values and a component of the second display image having smaller grayscale value for regulation of the brightness value of the backlight circuit, so as to increase the ratio of the grayscale value of the main color tone component of the pixel, and increase the ratio of grayscale value of the main color tone component among all other components, to make the color represented on the display panel closer to the main color tone, thereby solving the color shift problem of the display panel under large view angle. Furthermore, the third component of the original display image having the minimum grayscale value is divided into a component of the first display image having the second largest grayscale value and a third component of the second display image for regulation of the brightness value of the backlight circuit, so as to solve the problem that the difference between the ratios of grayscale values of main color tone components of the low grayscale pixels under the front view angle and the large view angle is higher than that of the high grayscale pixels, and solve the color shift problem of the display panel when the display panel is viewed under large view angle.

The present disclosure disclosed herein has been described by means of specific embodiments. However, numerous modifications, variations and enhancements can be made thereto by those skilled in the art without departing from the spirit and scope of the disclosure set forth in the claims.

What is claimed is:

1. A method of driving a display device, comprising:

dividing an original display image into a first display image and a second display image, and wherein each of pixels of the original display image, the first display image and the second display image comprises components corresponding a color space, and the components comprise a first component, a second component and a third component;

acquiring a first mean value, a second mean value and a third mean value corresponding to the original display image, and wherein the first mean value, the second mean value and the third mean value are a mean value of the first components corresponding to the original display image, a mean value of the second components corresponding to the original display image, and a mean value of the third components corresponding to the original display image, respectively, and the first mean value is higher than the second mean value, and higher than the third mean value;

setting the mean value of the first components corresponding to the first display image, the mean value of the second components corresponding to the first display image, and the mean value of the third components corresponding to the first display image to be equal to the second mean value, and setting the mean value of the first components corresponding to the second display image and the mean value of the third components corresponding to the second display image to be equal to the third mean value, and setting the mean value of the second components corresponding to the second display image to be equal to a preset mean value;

regulating a brightness value of a backlight circuit according to the mean value of the first components corresponding to the original display image, the mean value of the second components corresponding to the original display image, and the mean value of the third components corresponding to the original display image, the mean value of the first components corresponding to the first display image, the mean value of the second components corresponding to the first display image, and the mean value of the third components corresponding to the first display image, and the mean value of the first components corresponding to the second display image, the mean value of the second components corresponding to the second display image, and the mean value of the third components corresponding to the second display image;

acquiring a drive component corresponding to the pixel of the second display image according to the brightness value of the backlight circuit before regulation, the brightness value of the backlight circuit after regulation, one of the first component, the second component, and the third component corresponding to the pixel of the original display image, and a drive component corresponding to the pixel of the first display image, and wherein the drive component corresponding to the pixel of the first display image is equal to a second largest component among the first component, the second component and the third component corresponding to the pixel of the original display image; and driving the pixel units of the display device for display, according to the drive components corresponding to the pixels of the first display image and the drive components corresponding to the pixels of the second display image.

2. The driving method according to claim 1, wherein the preset mean value is equal to zero.

3. The driving method according to claim 1, after the step of acquiring the drive components corresponding to the pixels of the second display image, according to the brightness value of the backlight circuit before regulation, the brightness value of the backlight circuit after regulation, one of the first component, the second component, and the third component corresponding to the pixel of the original display image, and the drive component corresponding to the pixel of the first display image, the driving method further comprising:

determining a relationship between the acquired drive component corresponding to the pixel of the second display image and zero, and a relationship between the acquired drive component corresponding to the pixel of the second display image and the first component corresponding to the pixel of the original display image;

wherein when the acquired drive component corresponding to the pixel of the second display image is lower than zero, the drive component corresponding to the pixel of the second display image is set to be equal to zero;

wherein when the acquired drive component corresponding to the pixels of the second display image are higher than a maximum component corresponding to the pixel, the drive components corresponding to the pixel of the second display image is set to be equal to the maximum component corresponding to the pixel.

4. The driving method according to claim 1, wherein the backlight circuit comprises a first backlight circuit, a second backlight circuits and a third backlight circuit, and the step of regulating the brightness value of the backlight circuit according to the mean value of the first components corresponding to the original display image, the mean value of the second components corresponding to the original display image, and the mean value of the third components corresponding to the original display image, the mean value of the first components corresponding to the first display image, the mean value of the second components corresponding to the first display image, and the mean value of the third components corresponding to the first display image, and the mean value of the first components corresponding to the second display image, the mean value of the second components corresponding to the second display image, and the mean value of the third components corresponding to the second display image, further comprises:

regulating a brightness value of the first backlight circuit according to grayscale brightness values of the mean values of the first components corresponding to the original display image, the first display image and the second display image respectively;

regulating a brightness value of the second backlight circuit according to grayscale brightness values of the mean values of the second components corresponding to the original display image, the first display image and the second display image respectively; and regulating a brightness value of the third backlight circuit according to grayscale brightness values of the mean values of the third components corresponding to the original display image, the first display image and the second display image, respectively.

5. The driving method according to claim 1, wherein the backlight circuit comprise a first backlight circuit, a second backlight circuits and a third backlight circuit, and the step of acquiring the drive component corresponding to the pixel of the second display image according to the brightness value of the backlight circuit before regulation, brightness value of the backlight circuit after regulation, one of the first component, the second component, and the third component corresponding to the pixel of the original display image, and the drive component corresponding to the pixel of the first display image, further comprise:

acquiring a drive component corresponding to the first component of the pixel of the second display image, according to the brightness value of the first backlight circuit before regulation, the brightness value of the first backlight circuit after regulation, and the first component corresponding to the pixel of the original display image, and the drive component corresponding to the pixel of the first display image;

acquiring a drive component corresponding to the second component of the pixel of the second display image, according to the brightness value of the second backlight circuit before regulation, the brightness value of the second backlight circuits after regulation, and the second component corresponding to the pixel of the original display image, and the drive component corresponding to the pixel of the first display image;

acquiring a drive component corresponding to the third component of the pixel of the second display image according to the brightness value of the third backlight circuit before regulation, the brightness value of the third backlight circuit after regulation, and the third component corresponding to the pixel of the original display image, and the drive component corresponding to the pixel of the first display image.

6. A driving method, comprising:

dividing pixels of an original display image into a plurality of areas, wherein each of the plurality of areas comprises the pixels;

dividing a frame original display image in one of the plurality of areas into a first display image and a second display image;

acquiring a first mean value, a second mean value and a third mean value corresponding to the original display image in a divided area or multiple divided areas;

setting a mean value of first components corresponding to the first display image in the divided area or the multiple divided areas, a mean value of second components corresponding to the first display image in the divided area or the multiple divided areas, and a mean value of third components corresponding to the first display image in the divided area or the multiple divided areas to be equal to the second mean value, and setting a mean value of the first components corresponding to the second display image in the divided area or the multiple divided areas and a mean value of the third components corresponding to the second display image in the divided area or the multiple divided areas to be equal to the third mean value, and setting a mean value of the second components corresponding to the second display image in the divided area or the multiple divided areas to be equal to a preset mean value;

regulating a brightness value of a backlight circuit corresponding to the divided area or the multiple divided areas, according to the mean value of the first components corresponding to the original display image in the divided area or the multiple divided areas, the mean value of the second components corresponding to the original display image in the divided area or the multiple divided areas, and the mean value of the third components corresponding to the original display image in the divided area or the multiple divided areas, the mean value of the first components corresponding to the first display image in the divided area or the multiple divided areas, the mean value of the second components corresponding to the first display image in the divided area or the multiple divided areas, and the mean value of the third components corresponding to the first display image in the divided area or the multiple divided areas, and the mean value of the first components corresponding to the second display image in the divided area or the multiple divided areas, the mean value of the second components corresponding to the second display image in the divided area or the multiple divided areas, and the mean value of the third components corresponding to the second display image in the divided area or the multiple divided areas;

acquiring a drive component corresponding to the pixel of the second display image in the divided area or the multiple divided areas, according to the brightness value of the backlight circuit corresponding to the divided area or the multiple divided areas before regulation, the brightness value of the backlight circuit corresponding to the divided area or the multiple divided areas after regulation, one of the first component, the second component, and the third component corresponding to the pixel of the original display image in the divided area or the multiple divided areas, and the drive component corresponding to the pixel of the first display image in the divided area or the multiple divided areas; and driving the pixel units corresponding to the divided area or the multiple divided areas of the display device for display, according to the drive components corresponding to the pixels of the first display image in the divided area or the multiple divided areas, the drive components corresponding to the pixels of the second display image in the divided area or the multiple divided areas.

7. The driving method according to claim 6, wherein the preset mean value is equal to zero.

8. The driving method according to claim 6, after acquiring the drive component corresponding to the pixel of the second display image in the divided area or the multiple divided areas according to the brightness value of the backlight circuit corresponding to a backlight circuit area before regulation, the brightness value of the backlight circuit corresponding to the backlight circuit area after regulation, one of the first component, the second component, and the third component corresponding to the pixel of the original display image in the divided area or the multiple divided areas, and the drive component corresponding to the pixel of the first display image in the divided area or the multiple divided areas, further comprising:

determining a relationship between the acquired drive component corresponding to the pixel of the second display image in the divided area or the multiple divided areas and zero, and a relationship between the acquired drive component and the first component corresponding to the pixel of the original display image in the divided area or the multiple divided areas;

setting the drive component corresponding to the pixel of the second display image in the divided area or the multiple divided areas to be equal to zero when the acquired drive component corresponding to the pixel of the second display image in the divided area or the multiple divided areas is lower than zero; and setting the drive component corresponding to the pixel of the second display image in the divided area or the multiple divided areas to be equal to the maximum component corresponding to the pixel when the acquired drive component corresponding to the pixel of the second display image in the divided area or the multiple divided areas is higher than the maximum component corresponding to the pixel.

9. The driving method according to claim 6, wherein the backlight circuit corresponding to a backlight circuit area comprises a first backlight circuit, a second backlight circuit and a third backlight circuit, and the step of regulating the brightness value of the backlight circuit corresponding to the backlight circuit area according to the mean value of the first components corresponding to the original display image in the divided area or the multiple divided areas, the mean value of the second components corresponding to the original display image in the divided area or the multiple divided areas, and the mean value of the third components corresponding to the original display image in the divided area or the multiple divided areas, the mean value of the first components corresponding to the first display image, the mean value of the second components corresponding to the first display image, and the mean value of the third components corresponding to the first display image, and the mean value of the first components corresponding to the second display image, the mean value of the second components corresponding to the second display image, and the mean value of the third components corresponding to the second display image, further comprises:

regulating a brightness value of the first backlight circuit in the backlight circuit area according to the grayscale brightness values of the mean values of the first components corresponding to the original display image, the first display image and the second display image in the divided area or the multiple divided areas respectively;

regulating a brightness value of the second backlight circuit in the backlight circuit area according to the grayscale brightness values of the mean values of the second components corresponding to the original display image, the first display image and the second display image in the divided area or the multiple divided areas respectively;

regulating a brightness value of the third backlight circuit in the backlight circuit area according to the grayscale brightness values of the mean values of the third components corresponding to the original display image, the first display image and the second display image in the divided area or the multiple divided areas respectively.

10. The driving method according to claim 6, wherein the backlight circuit corresponding to a backlight circuit area comprises a first backlight circuit, a second backlight circuits and a third backlight circuit, and the step of acquiring the drive component corresponding to the pixel of the second display image in the divided area or the multiple divided areas according to the brightness value of the backlight circuit corresponding to the backlight circuit area before regulation, the brightness value of the backlight circuit corresponding to the divided area or the multiple divided areas after regulation, the components corresponding to the pixels of the original display image in the divided area or the multiple divided areas, and the drive component corresponding to the pixel of the first display image in the divided area or the multiple divided areas, further comprises:

acquiring the drive component of the first component corresponding to the pixel of the second display image in the divided area or the multiple divided areas, according to the brightness value of the first backlight circuit in the backlight circuit area before regulation, the brightness value of the second backlight circuit in the backlight circuit area after regulation, the first component corresponding to the pixel of the original display image in the divided area or the multiple divided areas, and the drive component corresponding to the pixel of the first display image in the divided area or the multiple divided areas;

acquiring the drive component of the second component corresponding to the pixel of the second display image in the divided area or the multiple divided areas, according to the brightness value of the second backlight circuits in the backlight circuit area before regulation, the brightness value of the second backlight circuits corresponding to the backlight circuit area after regulation, the second component corresponding to the pixel of the original display image in the divided area or the multiple divided areas, and the drive component corresponding to the pixel of the first display image in the divided area or the multiple divided areas; and acquiring the drive component of the third component corresponding to the pixel of the second display image in the divided area or the multiple divided areas, according to the brightness value of the third backlight circuit in the backlight circuit area before regulation, the brightness value of the third backlight circuit corresponding to the backlight circuit area after regulation, the third component corresponding to the pixel of the original display image in the divided area or the multiple divided areas, and the drive component corresponding to the pixel of the first display image in the divided area or the multiple divided areas.

11. A display device, comprising:

an image dividing circuit configured to divide an original display image into a first display image and a second display image, wherein each of pixels of the original display image, the first display image and the second display image comprises components corresponding to a color space, and the components comprise a first component, a second components and a third component;

a mean value acquisition circuit electrically connected to the image dividing circuit, and configured to acquire a first mean value, a second mean value and a third mean value corresponding to the original display image, and wherein the first mean value, the second mean value and the third mean value are a mean value of the first components corresponding to the original display image, a mean value of the second components corresponding to the original display image, and a mean value of the third components corresponding to the original display image, respectively, and the first mean value is higher than the second mean values, and higher than the third mean value;

a component setting circuit electrically connected to the mean value acquisition circuit, and configured to set the mean value of the first components corresponding to the first display image, the mean value of the second components corresponding to the first display image, and the mean value of the third components corresponding to the first display image to be equal to a second mean value, and set the mean value of the first components corresponding to the second display image and the mean value of the third components corresponding to the second display image to be equal to the third mean value, and set the mean value of the second components corresponding to the second display image to be equal to a preset mean value;

a backlight regulation circuit electrically connected to the component setting circuit, and configured to regulate a brightness value of a backlight circuit according to the mean value of the first components corresponding to the original display image, the mean value of the second components corresponding to the original display image, and the mean value of the third components corresponding to the original display image, the mean value of the first components corresponding to the first display image, the mean value of the second components corresponding to the first display image, and the mean value of the third components corresponding to the first display image, and the mean value of the first components corresponding to the second display image, the mean value of the second components corresponding to the second display image, and the mean value of the third components corresponding to the second display image;

a drive component acquisition circuit electrically connected to the backlight regulation circuit, configured to acquire a drive component corresponding to the pixel of the second display image according to the brightness value of the backlight circuit before regulation, the brightness value of the backlight circuit after regulation, one of the first component, the second component, and the third component corresponding to the pixel of the original display image, and the drive component corresponding to the pixel of the first display image, and wherein the drive components corresponding to the pixel of the first display image is equal to a second largest component among the first component, the second component, and the third component corresponding to the pixel of the original display image; and a driver circuit electrically connected to the drive component acquisition circuit, and configured to according to the drive components corresponding to the pixels of the first display image, and the drive components corresponding to the pixels of the second display image, driving the pixel unit of the display device for display.

12. The display device according to claim 11, wherein the preset mean value is equal to zero.

13. The display device according to claim 11, further comprising:

a relationship determination circuit electrically connected to the drive component acquisition circuit, and configured to determine a relationship between the acquired drive component corresponding to the pixel of the second display image and zero, and a relationship between the acquired drive component to the pixel of the second display image and the first component corresponding to the pixel of the original display image; and a drive component setting circuit electrically connected to the relationship determination circuit, and configured to set the drive component corresponding to the pixel of the second display image to be equal to zero when the acquired drive component corresponding to the pixel of the second display image is lower than zero, and set the drive component corresponding to the pixel of the second display image to be equal to the maximum component corresponding to the pixel when the acquired drive component corresponding to the pixel of the second display image is higher than the maximum component corresponding to the pixel.

14. The display device according to claim 11, wherein the backlight circuit comprise a first backlight circuit, a second backlight circuits and a third backlight circuit, and the backlight regulation circuit is configured to:

regulate a brightness value of the first backlight circuit according to grayscale brightness values of the mean values of the first components corresponding to the original display image, the first display image and the second display image respectively;

regulate a brightness value of the second backlight circuit according to grayscale brightness values of the mean values of the second components corresponding to the original display image, the first display image and the second display image respectively; and regulate a brightness value of the third backlight circuit according to grayscale brightness values of the mean values of the third components corresponding to the original display image, the first display image and the second display image, respectively.

15. The display device according to claim 11, wherein the backlight circuit comprises a first backlight circuit, a second backlight circuits and a third backlight circuit, and the drive component acquisition circuit is configured to:

acquire a drive component corresponding to the first component of the pixel of the second display image according to the brightness value of the first backlight circuit before regulation, the brightness value of the first backlight circuit after regulation, and the first component corresponding to the pixel of the original display image, and the drive component corresponding to the pixel of the first display image;

acquire a drive component corresponding to the second components of the pixel of the second display image according to the brightness value of the second backlight circuits before regulation, the brightness value of the second backlight circuits after regulation, and the second components corresponding to the pixel of the original display image, and the drive component corresponding to the pixel of the first display image;

acquire a drive component corresponding to the third component of the pixel of the second display image according to the brightness value of the third backlight circuit before regulation, the brightness value of the third backlight circuit after regulation, and the third component corresponding to the pixel of the original display image, and the drive component corresponding to the pixel of the first display image.

16. The display device according to claim 11, further comprising:

an area dividing circuit configured to divide the pixels of the original display image into a plurality of areas, wherein each of the plurality of area comprises pixels;

the image dividing circuit electrically connected to the area dividing circuit, and configured to divide the original display image in one of the plurality of area into the first display image and the second display image;

the mean value acquisition circuit configured to acquire the first mean value, the second mean value and the third mean value corresponding to the original display image in the divided area or the multiple divided areas;

the component setting circuit, and configured to set the mean value of the first components corresponding to the first display image in the divided area or the multiple divided areas, the mean value of the second components corresponding to the first display image in the divided area or the multiple divided areas, and the mean value of the third components corresponding to the first display image in the divided area or the multiple divided areas to be equal to the second mean values, and set the mean value of the first components corresponding to the second display image in the divided area or the multiple divided areas and the mean value of the third components corresponding to the second display image in the divided area or the multiple divided areas to be equal to the third mean value, and set the mean value of the second components corresponding to the second display image to be equal to the preset mean value;

the backlight regulation circuit configured to regulate the brightness value of the backlight circuit corresponding to a backlight circuit area, according to the mean value of the first components corresponding to the original display image in the divided area or the multiple divided areas, the mean value of the second components corresponding to the original display image in the divided area or the multiple divided areas, and the mean value of the third components corresponding to the original display image in the divided area or the multiple divided areas, the mean value of the first components corresponding to the first display image in the divided area or the multiple divided areas, the mean value of the second components corresponding to the first display image in the divided area or the multiple divided areas, and the mean value of the third components corresponding to the first display image in the divided area or the multiple divided areas, and the mean value of the first components corresponding to the second display image in the divided area or the multiple divided areas, the mean value of the second components corresponding to the second display image in the divided area or the multiple divided areas, and the mean value of the third components corresponding to the second display image in the divided area or the multiple divided areas;

the drive component acquisition circuit, configured to acquire the drive component corresponding to the pixel of the second display image in the divided area or the multiple divided areas according to the brightness value of the backlight circuit in the backlight circuit area before regulation, the brightness value of the backlight circuit in the backlight circuit area after regulation, the component corresponding to the pixel of the original display image in the divided area or the multiple divided areas, and the drive component corresponding to the pixel of the first display image in the divided area or the multiple divided areas;

the driver circuit configured to drive the pixel units corresponding to the divided area or the multiple divided areas of the display device for display, according to the drive components corresponding to the pixels of the first display image in the divided area or the multiple divided areas, the drive components corresponding to the pixels of the second display image in the divided area or the multiple divided areas.

17. The display device according to claim 16, wherein the backlight circuit corresponding to the backlight circuit area comprises a first backlight circuit, a second backlight circuit and a third backlight circuit, and the backlight regulation circuit configured to:

regulate the brightness value of the first backlight circuit in the backlight circuit area according to grayscale brightness values of the mean values of the first components corresponding to the original display image, the first display image and the second display image in the divided area or the multiple divided areas respectively;

regulate a brightness value of the second backlight circuit in the backlight circuit area according to the grayscale brightness values of the mean values of the second components corresponding to the original display image, the first display image and the second display image in the divided area or the multiple divided areas respectively; and regulate a brightness value of the third backlight circuit in the backlight circuit area according to grayscale brightness values of the mean values of the third components corresponding to the original display image, the first display image and the second display image in the divided area or the multiple divided areas respectively.

18. The display device according to claim 16, wherein the backlight circuit corresponding to the backlight circuit area comprises a first backlight circuit, a second backlight circuit and a third backlight circuit, and the drive component acquisition circuit configured to:

acquire drive component of the first component corresponding to the pixel of the second display image in the divided area or the multiple divided areas according to the brightness value of the first backlight circuit in the backlight circuit area before regulation, the brightness value of the first backlight circuit in the backlight circuit area after regulation, the first component corresponding to the pixel of the original display image in the divided area or the multiple divided areas, and the drive component corresponding to the pixel of the first display image in the divided area or the multiple divided areas;

acquire a drive component of the second components corresponding to the pixel of the second display image in the divided area or the multiple divided areas, according to the brightness value of the second backlight circuits corresponding to the divided area or the multiple divided areas before regulation, the brightness value of the second backlight circuits corresponding to the divided area or the multiple divided areas after regulation, the second components corresponding to the pixel of the original display image in the divided area or the multiple divided areas, and the drive component corresponding to the pixel of the first display image in the divided area or the multiple divided areas; and acquire a drive component of the third component corresponding to the pixel of the second display image in the divided area or the multiple divided areas according to the brightness value of the third backlight circuit in the backlight circuit area before regulation, the brightness value of the third backlight circuit in the backlight circuit area after regulation, the third component corresponding to the pixel of the original display image in the divided area or the multiple divided areas, and the drive component corresponding to the pixel of the first display image in the divided area or the multiple divided areas.

* * * * *